US010166799B2

(12) United States Patent
Rabe et al.

(10) Patent No.: US 10,166,799 B2
(45) Date of Patent: Jan. 1, 2019

(54) SERVICE STATIONS FOR HANDHELD FLUID JET APPARATUSES

(71) Applicant: The Procter & Gamble Company, Cincinnati, OH (US)

(72) Inventors: Thomas Elliot Rabe, Baltimore, MD (US); Paul John Edward Vernon, West Chester, OH (US); Grant Edward Anders Striemer, Fairfield Township, OH (US); Janette Villalobos Lingoes, Cincinnati, OH (US); Rebecca Ashley Kolakoski, Cincinnati, OH (US); Brian Lee Floyd, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/961,047

(22) Filed: Dec. 7, 2015

(65) Prior Publication Data

US 2017/0157962 A1 Jun. 8, 2017

(51) Int. Cl.

| | |
|---|---|
| ***B41J 29/02*** | (2006.01) |
| ***B41J 2/165*** | (2006.01) |
| ***B41J 3/36*** | (2006.01) |

(52) U.S. Cl.

CPC ..... *B41J 29/023* (2013.01); *B41J 2/16511* (2013.01); *B41J 2/16544* (2013.01);
(Continued)

(58) Field of Classification Search

CPC .... B41J 29/04; B41J 2/16511; B41J 2/16544; B41J 2/16579; B41J 2/175; B41J 3/36;
(Continued)

(56) References Cited

U.S. PATENT DOCUMENTS 5,980,018 A * 11/1999 Taylor ..... B41J 2/16547 347/31
6,199,973 B1 3/2001 Bartolome et al.
(Continued)

FOREIGN PATENT DOCUMENTS

| | | |
|---|---|---|
| DE | 3906335 | 8/1990 |
| DE | 19534327 | 2/1996 |

(Continued)

OTHER PUBLICATIONS

PCT International Search Report with Written Opinion in corresponding international application PCT/US2016/065050 dated Feb. 13, 2017.

(Continued)

*Primary Examiner* — Justin Seo
(74) *Attorney, Agent, or Firm* — Melissa Krasovec; Amanda Herman; Steven Robert Chuey

(57) ABSTRACT

A service station for servicing a handheld jet dispensing apparatus includes a fluid jet cartridge carrying a composition and a camera for capturing an image of a surface includes a body having a docking portion that is sized to receive the jet dispensing apparatus. A servicing portion is located adjacent the docking portion. The servicing portion is configured to receive a servicing cassette and to position the servicing cassette for interaction with nozzles of fluid jet cartridge of the jet dispensing apparatus for a cartridge servicing operation. An actuator is configured to move the servicing cassette during the cartridge servicing operation relative to the fluid jet cartridge of the handheld treatment apparatus with the handheld treatment apparatus in the docking portion.

12 Claims, 14 Drawing Sheets

(52) U.S. Cl.
CPC ..... *B41J 2/16547* (2013.01); *B41J 2/16579* (2013.01); *B41J 3/36* (2013.01); *B41J 2002/16514* (2013.01)

(58) Field of Classification Search
CPC ..... B41J 2/16547; B41J 29/17; B41J 2002/16514
See application file for complete search history.

(56) References Cited

U.S. PATENT DOCUMENTS

| | | | |
|---|---|---|---|
| 6,312,124 | B1 | 11/2001 | Esormeaux |
| 6,531,142 | B1 | 3/2003 | Rabe et al. |
| 7,648,364 | B2 | 1/2010 | Dauga |
| 7,731,326 | B2 | 6/2010 | Perez et al. |
| 7,890,152 | B2 | 2/2011 | Edgar |
| 8,007,062 | B2 | 8/2011 | Edgar |
| 8,027,505 | B2 | 9/2011 | Edgar |
| 8,128,192 | B1 | 3/2012 | Simmons |
| 8,184,901 | B2 | 5/2012 | Edgar |
| 8,231,292 | B2 | 7/2012 | Rabe |
| 8,695,610 | B2 | 4/2014 | Samain |
| D750,772 | S | 2/2016 | Rabe |
| D750,225 | S | 3/2016 | Rabe |
| 9,616,668 | B1 | 4/2017 | Rabe et al. |
| 9,616,669 | B2 | 4/2017 | Aruga et al. |
| 9,616,692 | B1 | 4/2017 | Rabe et al. |
| 9,782,971 | B2 | 10/2017 | Vernon et al. |
| 2003/0060810 | A1 | 3/2003 | Syrowicz |
| 2004/0130587 | A1 | 7/2004 | Yakura et al. |
| 2004/0181196 | A1 | 9/2004 | Pickup et al. |
| 2006/0164460 | A1 | 7/2006 | Uwagaki et al. |
| 2007/0076045 | A1 | 4/2007 | James et al. |
| 2008/0194971 | A1 | 8/2008 | Edgar |
| 2008/0204503 | A1 | 8/2008 | Studer et al. |
| 2009/0025747 | A1 | 1/2009 | Edgar |
| 2010/0224205 | A1 | 9/2010 | Mitra |
| 2010/0224209 | A1 | 9/2010 | Rabe |
| 2010/0224210 | A1 | 9/2010 | Rabe |
| 2010/0224211 | A1 | 9/2010 | Samain |
| 2011/0129283 | A1 | 6/2011 | Samain |
| 2011/0155161 | A1 | 6/2011 | Samain |
| 2011/0159463 | A1 | 6/2011 | Rabe |
| 2011/0162673 | A1* | 7/2011 | Samain ..... A45D 44/005 132/317 |
| 2011/0285765 | A1 | 11/2011 | Lamontagne et al. |
| 2012/0081421 | A1 | 4/2012 | Kondo |
| 2015/0298459 | A1* | 10/2015 | Yasumoto ..... B41J 2/17503 347/86 |
| 2015/0360015 | A1 | 12/2015 | Rabe |
| 2015/0360016 | A1 | 12/2015 | Rabe |
| 2015/0360017 | A1 | 12/2015 | Rabe |
| 2015/0360018 | A1 | 12/2015 | Baker |
| 2015/0360019 | A1 | 12/2015 | Clancy |
| 2015/0360020 | A1 | 12/2015 | Wu |
| 2016/0022006 | A1 | 1/2016 | Rabe |
| 2016/0022008 | A1 | 1/2016 | Rabe |
| 2016/0022009 | A1 | 1/2016 | Rabe |
| 2016/0022010 | A1 | 1/2016 | Rabe |
| 2016/0022011 | A1 | 1/2016 | Rabe |
| 2016/0022972 | A1 | 1/2016 | Rabe |
| 2017/0156994 | A1 | 6/2017 | Lingoes et al. |

FOREIGN PATENT DOCUMENTS

| | | | |
|---|---|---|---|
| FR | 2933585 | B1 | 10/2011 |
| JP | 10181002 | | 7/1998 |
| JP | 2006297691 | A | 11/2006 |
| WO | WO2009036876 | | 3/2009 |
| WO | WO2010004531 | | 1/2010 |

OTHER PUBLICATIONS

Search Report and Written Opinion for PCT/US2016/065047 dated Mar. 31, 2017.
Search Report and Written Opinion for PCT/US2016/065048 dated Dec. 7, 2015.
International Search Report and Written Opinion for PCT/US2016/065049 dated Feb. 13, 2017.
Search Report and Written Opinion fir PCT/US2016/065051 dated Feb. 9, 2017.
U.S. Appl. No. 15/704,013, filed Sep. 14, 2017, Rabe, Thomas Elliot.
All Office Actions for U.S. Appl. No. 14/960,907, filed Dec. 7, 2015.
All Office Actions for U.S. Appl. No. 14/960,949, filed Dec. 7, 2015.
All Office Actions for U.S. Appl. No. 14/960,976, filed Dec. 7, 2015.
All Office Actions for U.S. Appl. No. 15/704,013, filed Dec. 7, 2015.

* cited by examiner

SERVICE STATIONS FOR HANDHELD FLUID JET APPARATUSES

FIELD

The present application relates to service stations for handheld electronic devices and, more particularly, to service stations for servicing handheld jet dispensing apparatuses.

BACKGROUND

Inkjet devices, piezo and thermal, are common for both personal and industrial printing purposes. Most commonly, such devices are found in consumer homes as a means to create high quality prints and photos. In consumer applications there is a high need for reliable performance with minimal effort from the consumer. Because of this all existing consumer printing devices contain sophisticated processes for maintaining a high print quality. It is common for consumer inkjet printing devices to contain thousands of individual nozzles with each nozzle as small as 5-20 microns. Additionally, most inks in such devices are volatile and are prone to drying out quickly when exposed to air. Due to the small and numerous nozzles and fast dry times, it is difficult to keep all nozzles working properly over the course of thousands of printed pages and potentially long periods of time between prints. Due to these requirements much effort has been taken by printer manufacturers to devise mechanisms that keep the printing nozzles performing well. Most consumers have no knowledge of all of the servicing that occurs to ensure good print quality as it occurs automatically.

While servicing nozzles of a stationary inkjet printing device is known, there has been little need to consider how to automatically service inkjet nozzles for a handheld printing device. Handheld inkjet printing devices are uncommon and usually used for industrial tasks like labeling boxes during manufacturing. In such cases the servicing needs of nozzles is performed manually. These handheld printers require removal of the inkjet cartridge after each use and manually wiping and capping the printhead. For such industrial applications this may be acceptable. However, there has not been the need to create an automated servicing solution for handheld printing devices.

SUMMARY

In an embodiment, a service station for servicing a handheld jet dispensing apparatus which includes a fluid jet cartridge and a camera for capturing an image of a surface includes a body having a docking portion that is sized to receive the jet dispensing apparatus. A servicing portion is located adjacent the docking portion. The servicing portion is configured to receive a servicing cassette and to position the servicing cassette for interaction with nozzles of fluid jet cartridge of the jet dispensing apparatus for a cartridge servicing operation. An actuator is configured to move the servicing cassette during the cartridge servicing operation relative to the fluid jet cartridge of the handheld treatment apparatus with the handheld treatment apparatus in the docking portion.

In another embodiment, a service station for servicing a handheld jet dispensing apparatus which includes a fluid jet cartridge and a camera for capturing an image of a surface includes a body having a docking portion to receive the jet dispensing apparatus. A servicing portion located is adjacent the docking portion. The servicing portion includes at least one of a wiping element, a calibration element and a composition receiving element. An actuator is configured to move the at least one of the wiping element, calibration element and composition receiving element relative to nozzles of the fluid jet cartridge of the jet dispensing apparatus with the jet dispensing apparatus received by the docking portion.

In another embodiment, a method for servicing a handheld jet dispensing apparatus comprising a fluid jet cartridge and a camera for capturing an image of a surface using a service station is provided. The method includes positioning the jet dispensing apparatus in a docking portion defined in a body of the service station that is sized to receive the handheld skin treatment apparatus. A servicing cassette is actuated relative to the jet dispensing apparatus. The servicing cassette is located at a service portion adjacent the docking portion. The servicing cassette is located for interaction with nozzles of the fluid jet cartridge for a cartridge servicing operation.

Embodiments described herein can solve many problems with prior devices and methods. Specifically, a service station is provided that can service the handheld fluid jet apparatuses described herein by wiping, exercising and calibrating the nozzles. Further, the camera lens used for imaging can also be wiped. Such servicing can improve results by improving both accuracy and precision of composition deposition.

BRIEF DESCRIPTION OF THE DRAWINGS

While the specification concludes with claims particularly pointing out and distinctly claiming the present invention, it is believed the same will be better understood from the following description taken in conjunction with the accompanying drawing in which:

DETAILED DESCRIPTION

Embodiments described herein may be understood more readily by reference to the following detailed description. It is to be understood that the scope of the claims is not limited to the specific compositions, methods, conditions, devices, or parameters described herein, and that the terminology used herein is not intended to be limiting. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

All percentages and ratios used herein are by weight of the total composition, and all measurements made are at 25° C., unless otherwise designated.

Overall Service Station

Embodiments described herein generally relate to a service station for servicing a handheld jet dispensing apparatus. The service station may service any one or more components of the jet dispensing apparatus described herein such as a fluid jet cartridge and a camera for capturing an image of a surface. For example, the service station may include a wiping element that can be used to wipe one or both of a lens of the camera to remove any debris thereon and a plurality of nozzles of the fluid jet cartridge to remove any skin care composition or other materials accumulating thereon. The service station may also include a capping assembly including a capping element that can be used to cap the nozzles of the fluid jet cartridge to reduce any dried fluid that may accumulate on the nozzles and affect the performance of the jet dispensing apparatus.

Figure 1:
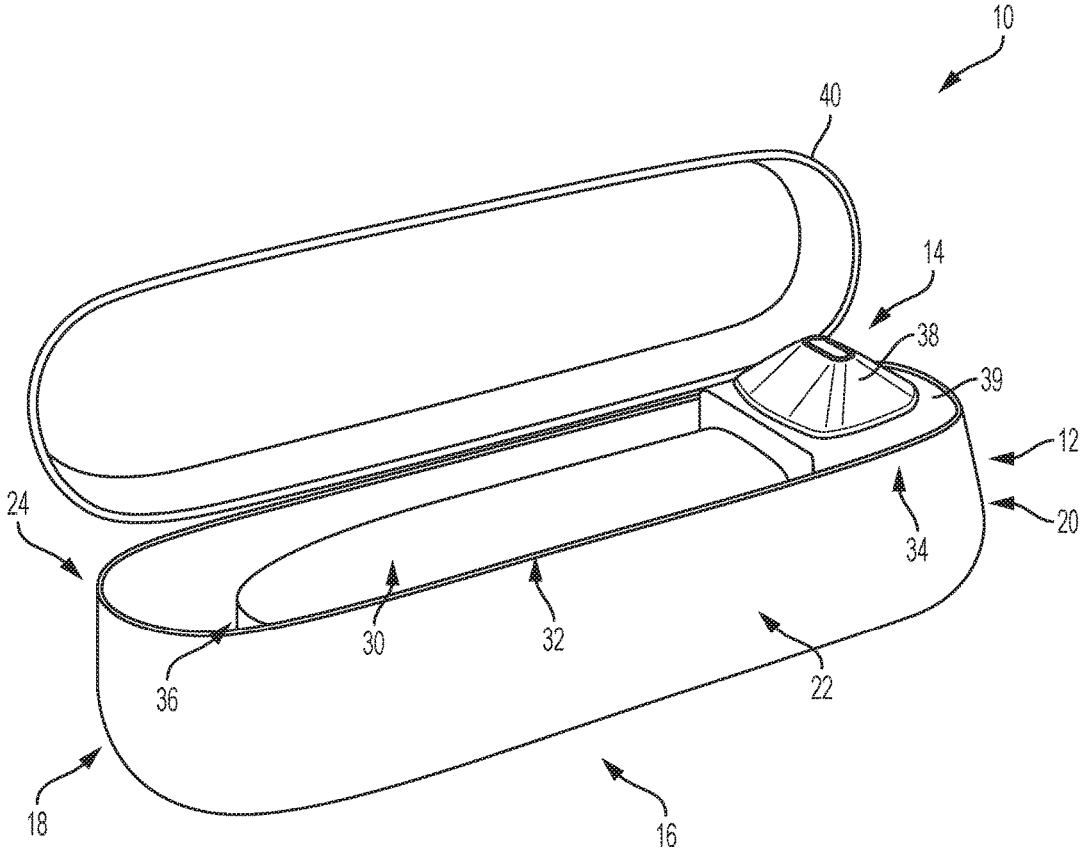
FIG. 1 is a perspective view of a service station for servicing a jet dispensing apparatus according to one or more embodiments described herein.

Referring to FIG. 1, a service station 10 includes an apparatus receiving body 12 having a front 14, back 16, ends 18 and 20 and sides 22 and 24 extending between the front 14, back 16, ends 18 and 20 and sides 22 and 24 defining a volume that is at least partially sized to receive a handheld jet dispensing apparatus 30 therein. As used herein, the term "jet dispensing apparatus" refers to a device that propels droplets of fluid (e.g., a skin care composition or other composition) onto a surface (e.g., skin or other suitable surface depending on the composition). The jet dispensing apparatus 30 may utilize any suitable fluid ejection mechanism, such as thermal, piezoelectric, etc. While the apparatus receiving body 12 is illustrated as being somewhat cuboid, any suitable shape may be used, such as spheres, cylinders, pyramids, prisms, and combinations of shapes, themed shapes such as stars or logos or irregular shapes.

The apparatus receiving body 12 has a docking portion 32 and a servicing portion 34. The docking portion 33 occupies a larger volume of the apparatus receiving body 12 and includes a recess or pocket 36 that is size to receive at least a portion of the jet dispensing apparatus 30 therein. In the illustrated example, the pocket 36 is sized to receive the entire length of the jet dispensing apparatus 30 with a nozzle cover 38 of the jet dispensing apparatus 30 removed. The nozzle cover 38 of the jet dispensing apparatus 30 may be removed and placed in the servicing portion 34 (e.g., on a magnetic floor 39) for storage in order to expose components of the jet dispensing apparatus 30 for a servicing operation, as will be described in greater detail below.

The service station 10 may further include a lid or door 40 that can be removably attached to the apparatus receiving body 12. The door 40 may be hingedly connected to the apparatus receiving body 12 as shown. In some embodiments, the door 40 may slide or otherwise move relative to the apparatus receiving body 12 between open and closed configurations. The door 40 may be opened manually or automatically, for example, in response to user input. In some embodiments, the door 40 may be locked manually and/or automatically. For example, the door 40 may lock in the closed configuration during a servicing operation. Further, while the door 40 is illustrated as solid and extending across the entire length of the apparatus receiving body 12, the door 40 may not be solid (e.g., may be a mesh) and may not extend across the entire length of the apparatus receiving body 12. In some embodiments, multiple doors may be provided, for example, one associated with the docking portion 32 and another associated with the servicing portion 34.

Figure 2:
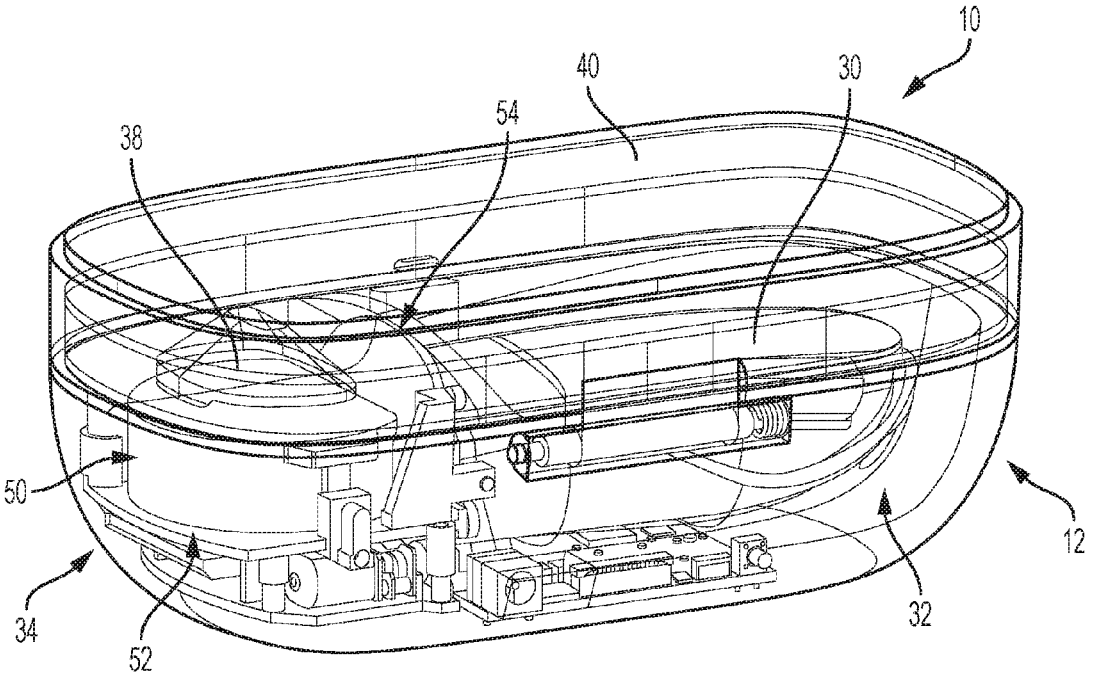
FIG. 2 illustrates another perspective view of the service station of FIG. 1.

Referring to FIG. 2, the service station 10 including the apparatus receiving body 12 and the door 40 is shown as somewhat transparent to illustrate the docking portion 32 and the servicing portion 34. The docking portion 32 and the servicing portion 34 are generally shaped and arranged to reliably position the jet dispensing apparatus 30 (without the nozzle cover 38) within the apparatus receiving body 12 relative to a servicing cassette 50 that is located within a chamber 52 of the servicing portion 34. The jet dispensing apparatus 30 is positioned to expose nozzles of a fluid jet cartridge (not shown in FIG. 2) to the servicing cassette 50 for a servicing operation. The docking portion 32 may also position the jet dispensing apparatus 30 relative to a fluid agitation system (generally designated 54) for imparting energy to the fluid jet cartridge for use in mixing of the composition within the fluid jet cartridge.

Figure 3:
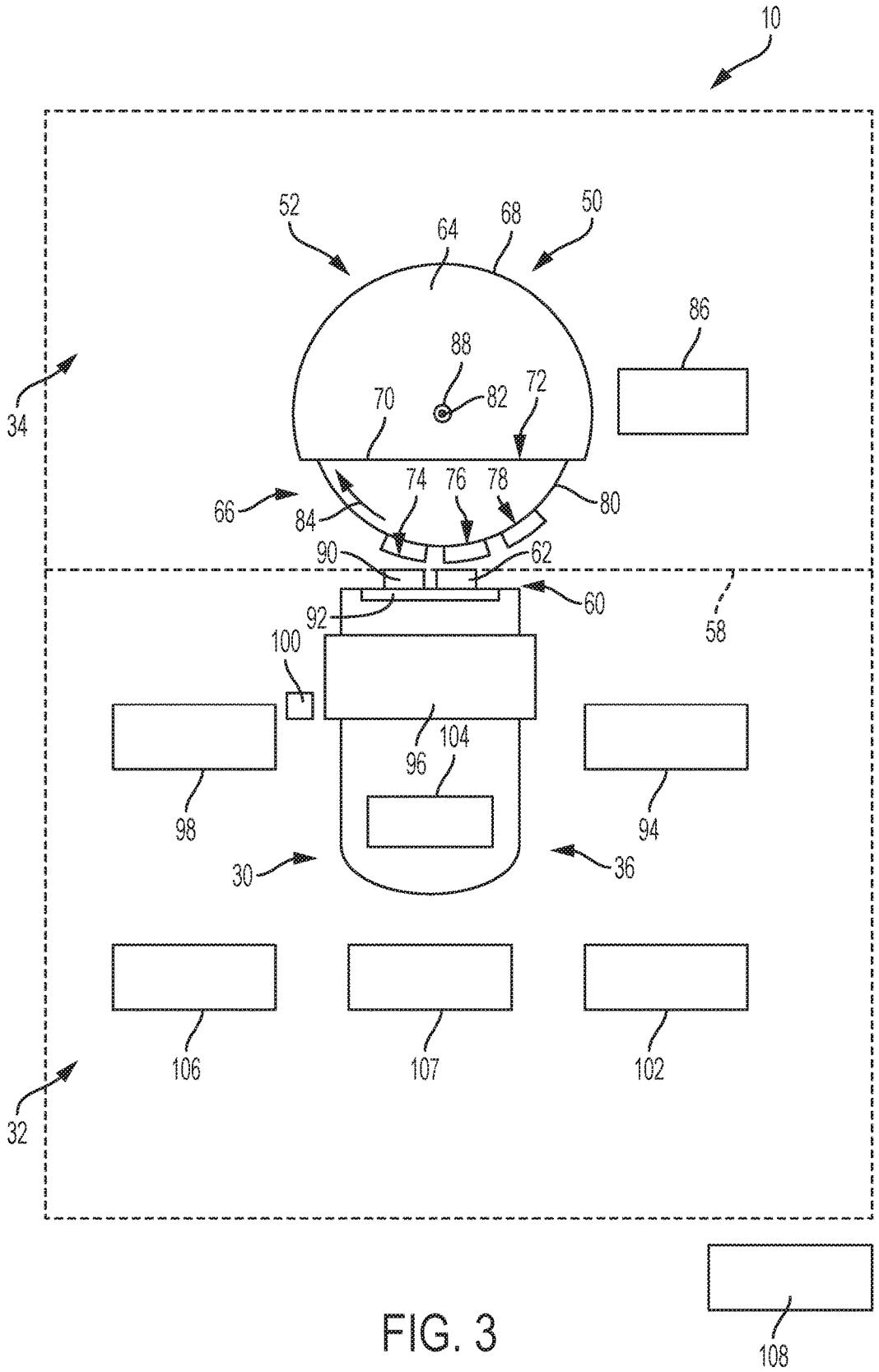
FIG. 3 illustrates a diagrammatic view of the service station of FIG. 1.

Referring now to FIG. 3, a diagrammatic view of the service station 10, jet dispensing apparatus 30 and servicing cassette 50 is illustrated. The service station 10 includes the docking portion 32 and the servicing portion 34 that may be separated by a wall 58. An access opening 60 can expose a nozzle array that is embedded in a cartridge die 62 once the jet dispensing apparatus 30 is located in the pocket 36 (FIG. 1) to the servicing cassette 50. In some embodiments, the jet dispensing apparatus 30 and the pocket 36 may be cooperatively shaped to aid in aligning the jet dispensing apparatus 30 with the servicing cassette 50.

The servicing cassette 50 is removably located within the chamber 52 of the servicing portion 34. The servicing cassette 50 includes an outer housing 64 and a rotatable actuation member 66 that is rotatably received within the outer housing 64. The outer housing 64 may have a rounded periphery 68 and a truncated portion 70 that provides a somewhat truncated cylinder that provides an exposing region 72 adjacent the access opening 60 for exposing the rotatable actuation member 66 during a servicing operation. The rotatable actuation member 66 is a support structure for carrying a wiping element 74, a composition receiving element 76 and a calibration element 78. The rotatable actuation member 66 may also have a rounded periphery 80 forming a cylindrical shape that cooperates with the outer housing 64 to allow rotation of the rotatable actuation member 66 relative to the outer housing 64. It should be noted that while the outer housing 64 is illustrated as a truncated cylinder, the outer housing 64 may be any suitable shape, such as cuboid, irregular, etc. having an internal geometry that allows for rotation of the rotatable actuation member 66 relative to the outer housing 64.

The rotatable actuation member 66 is rotatable relative to the outer housing 64 about a hub 88 providing an axis 82 in the direction of arrow 84. While clockwise rotation is illustrated, rotation may be counterclockwise in other embodiments. Further, there may be rotation in both directions, depending on a particular servicing routine, determined in a manner that will be described in greater detail below. The service station 10 includes an actuator 86 (e.g., a motor) that is operatively connected to the rotatable actuation member 66 by any suitable linkage (e.g., a gear train) to effect rotation of the rotatable actuation member 66 at any suitable, preselected rotation rate or rates. Rotation of the rotatable actuation member 66 can expose the wiping element 74, the composition receiving element 76 and the calibration element 78 to the nozzle array of the cartridge die 62 and a camera 90 that is used by the jet dispensing apparatus 30 to capture an image of a surface, such as a skin surface. A capping element 92 may be provided for capping the nozzle array of the cartridge die 62 at the end of the servicing operation.

A controller 94 or computing device is communicatively coupled to the actuator 86 for controlling operation of the actuator 86. The service station 10 may further include an energy imparting system 96 that is controlled by the controller 94 for imparting energy into the jet dispensing apparatus 30 and fluid jet cartridge for mixing the composition provided therein. As one example, the energy imparting system 96 may include an actuator 98 that is operatively connected to the jet dispensing apparatus 30 via a gear train 100 that physically moves (e.g., shakes, vibrates, turns, etc.) the jet dispensing apparatus 30 for imparting energy to a solution reservoir of the fluid jet cartridge. Various methods of imparting energy to the solution reservoir of the fluid jet cartridge will be described in greater detail below. The service station 10 may also include a communications module 102 that allows for communication (wired and/or wirelessly) with a communications module 104 of the jet dispensing apparatus 30.

An input/output module 106 may also be provided that allows for user input of various commands and/or output of various indicators to provide information to a user. The service station 10 may also include a charging assembly 107 that provides electrical contacts to facilitate an electrical connection between the jet dispensing apparatus 30 and an electrical supply 108. In the illustrated example, the electrical supply 108 is external to the service station 10 (e.g., an electrical outlet); however, the electrical supply may be internal to the service station 10 (e.g., a battery).

Servicing Cassette and Operation

Figure 4:
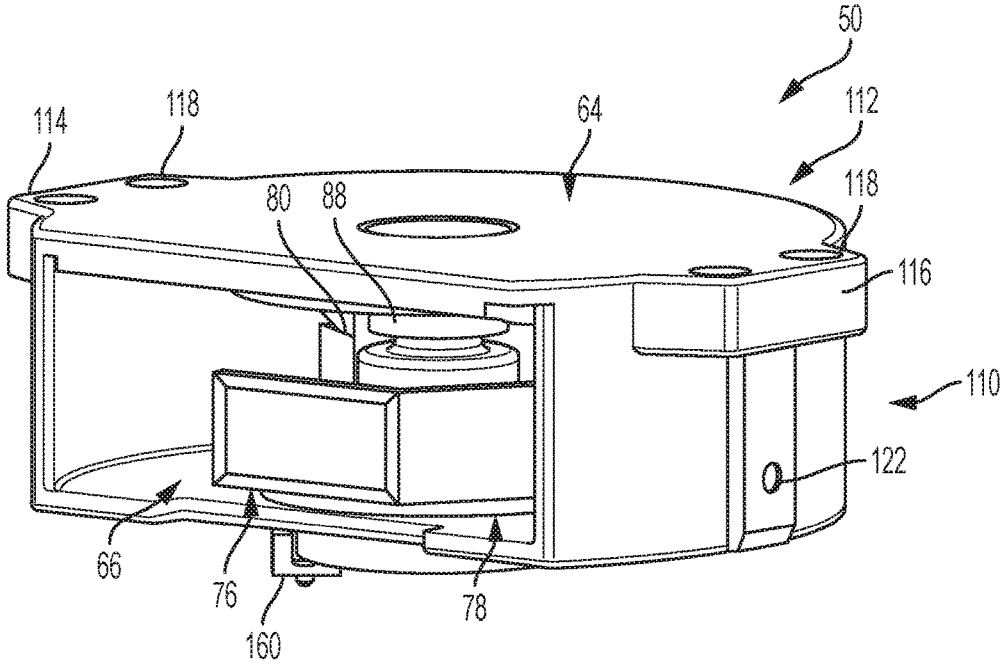
FIG. 4 illustrates a perspective view of a servicing cassette according to one or more embodiments described herein.
Figure 5:
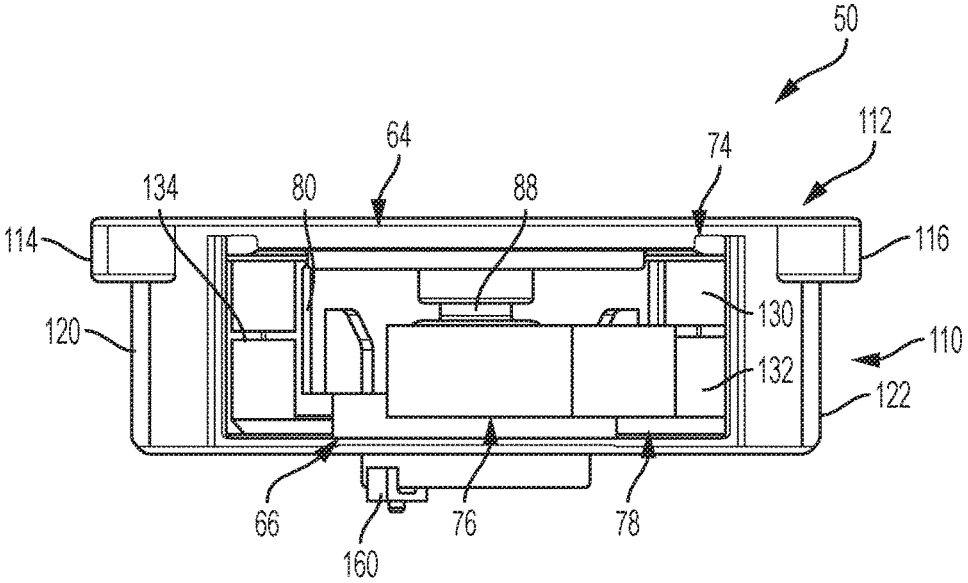
FIG. 5 is a front view of the servicing cassette of FIG. 4.

Referring to FIGS. 4 and 5, the servicing cassette 50 is illustrated in isolation and includes the outer housing 64 and rotatable actuation member 66 that is rotatably received within the outer housing 64. The outer housing 64 may be multi-part including a housing member 110 and a cap member 112 that is connected to the housing member 110, for example, using the flange portions 114 and 116 and fastener locations 118. While fasteners may be used, any other suitable connection may be used, such as welds, adhesives, etc. The housing member 110 and cap member 112 together define a capped volume that receives the rotatable actuation member 66.

As described above, the rotatable actuation member 66 is rotatable relative to the outer housing 64 about the hub 88. The outer housing 64 may be configured to be substantially stationary within the chamber 52 of the servicing portion 34 (FIG. 3) while the rotatable actuation member 66 rotates. To this end, the outer housing 64 may include anchoring features 120 and 122 in the form of projections or ribs that can mate with corresponding anchoring features (e.g., slots) within the chamber 52 of the servicing portion 34. The anchoring features 120 and 122 can also be used to force orientation of the servicing cassette 50 as it is being installed within the chamber 52. The flange portions 114 and 116 may also be used as anchoring features.

The rotatable actuation member 66 includes the wiping element 74, the composition receiving element 76 and the calibration element 78, each positioned about the periphery 80 of the rotatable actuation member 66. While the wiping element 74, the composition receiving element 76 and the calibration element 78 are illustrated in a particular arrangement positioned about the periphery 80 of the rotatable actuation member 66, other arrangements are possible depending, for example, on the composition type of the fluid jet cartridge and desired end use. It should also be noted that while the wiping element 74, the composition receiving element 76 and the calibration element 78 are each shown, only one or some of the wiping element 74, the composition receiving element 76 and the calibration element 78. Further, multiple of the wiping element 74, the composition receiving element 76 and the calibration element 78 may be included. Additionally, any one or more of the wiping element 74, the composition receiving element 76 and the calibration element 78 may be located externally of the rotatable actuation member 66 and even the servicing cassette 50.

Fluid (e.g., skin care composition or other composition) can collect around the nozzles of the fluid jet cartridge during normal usage of the jet dispensing apparatus 30. In some instances, the fluid may dry around the nozzles, which may create clogging issues and therefore reduced effectiveness of the jet dispensing apparatus 30. Further, the camera 90 (FIG. 3) may collect fluid and other contaminates in front of a lens of the camera 90, which can also reduce effectiveness of the jet dispensing apparatus 30 due to a reduction of image quality. To this end, the jet dispensing apparatus 30 can be serviced during a servicing operation by wiping the nozzles and the camera 90 using the wiping element 74.

Figure 6:
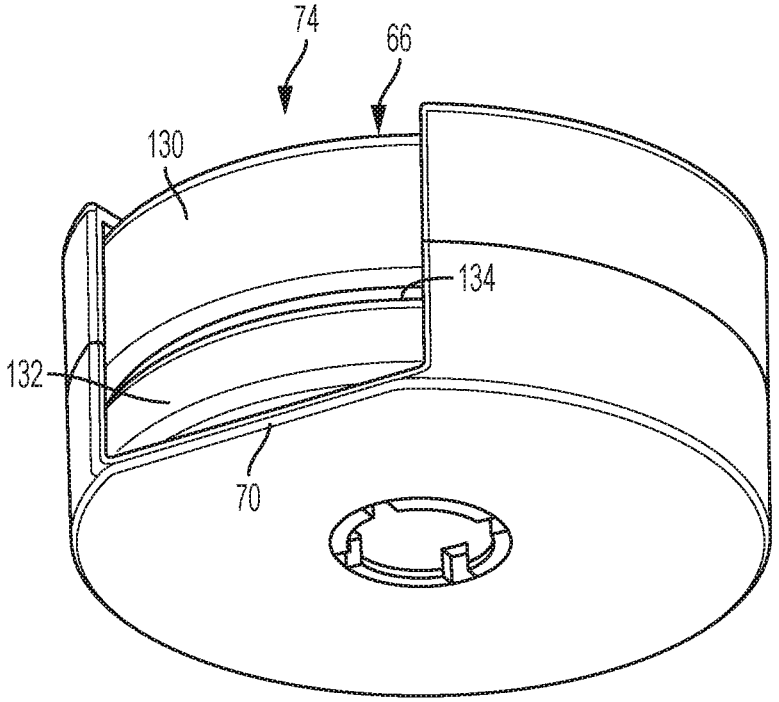
FIG. 6 illustrates operation of the servicing cassette of FIG. 4 with a wiping element in an exposed configuration.

Referring also to FIG. 6 illustrating the wiping element 74 in an exposed configuration through rotation of the rotatable actuation member 66, the wiping element 74 includes a nozzle wiping member 130 and a camera lens wiping member 132. The nozzle wiping member 130 extends about a portion of the periphery 80 of the rotatable actuation member 66 at a location arranged to contact the nozzles (FIG. 3) as the rotatable actuation member 66 rotates. Likewise, the camera lens wiping member 132 extends about a portion of the periphery 80 of the rotatable actuation member 66 at a location arranges to contact the camera 90 (FIG. 3) as the rotatable actuation member 66 rotates. In the illustrated example, the nozzle wiping member 130 and the camera lens wiping member 132 extend about the periphery 80 in a side-by-side fashion. In some embodiments, the nozzle wiping member 130 and the camera lens wiping member 132 may be separate components and separated by a gap 134. In other embodiments, the nozzle wiping member 130 and the camera lens wiping member 132 may be contiguous or may be both formed as a single strip of material. Thicknesses of the nozzle wiping member 130 and the camera lens wiping member 132 can be selected to increase the diameter or width of the rotatable actuation member 66 so as to extend beyond the truncated portion 70 and to come into contact with the nozzles and camera lens, respectively.

The nozzle wiping member 130 and the camera lens wiping member 132 may be formed of different or the same materials. Suitable materials include dry and/or pre-moistened materials, such as woven, non-woven, plastic, elastomer, foam, or some other material or combinations of materials.

Figure 7:
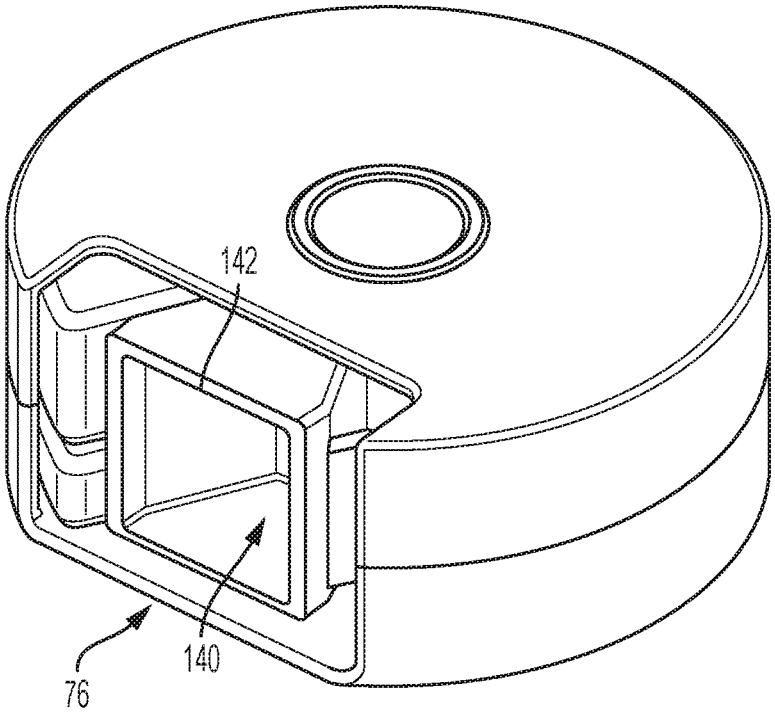
FIG. 7 illustrates operation of the servicing cassette of FIG. 4 with a fluid receiving element in an exposed configuration.

Referring now to FIG. 7, the composition receiving element 76 is illustrated in an exposed configuration through rotation of the rotatable actuation member 66. In some embodiments, it may be desirable to exercise the nozzles of the fluid jet cartridge by purging or spitting the nozzles. This can aid in clearing the nozzles and provide open nozzles during use. The composition receiving element 76 includes a reservoir 140 for receiving and retaining skin care composition ejected from the nozzles during purging. In some embodiments, the reservoir 140 may be provided by an open-ended receptacle 142, as illustrated by FIG. 7 and/or the reservoir may be provided by an absorbent material, such as a woven, non-woven or foam. In still some embodiments, the reservoir may be provided by the wiping element 74, which can retain the skin care composition. In these embodiments, the skin care composition itself may be used to pre-moisten the wiping element 74.

Figure 8:
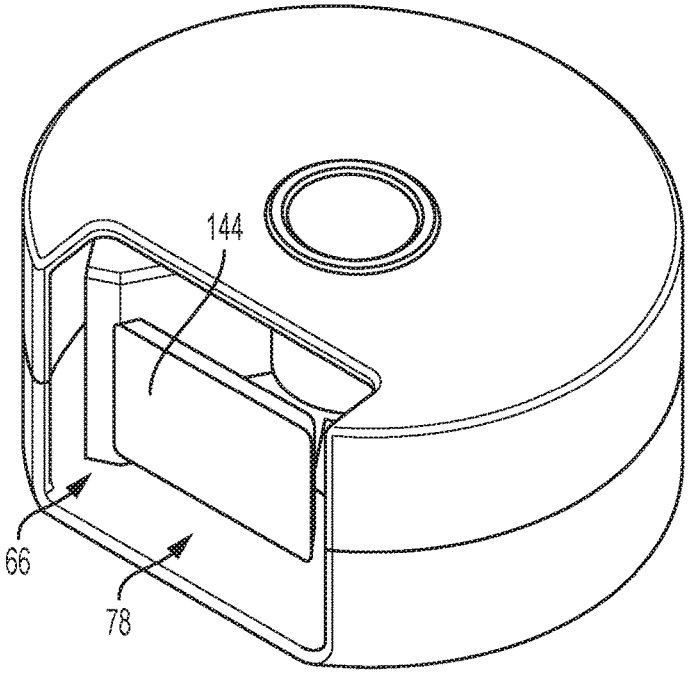
FIG. 8 illustrates operation of the servicing cassette of FIG. 4 with a calibration element in an exposed configuration.

Referring now to FIG. 8, the calibration element 78 is illustrated in an exposed configuration through rotation of the rotatable actuation member 66. In some embodiments, it may be desirable to calibrate the jet dispensing apparatus 30 to the particular nozzle firing pattern or tendencies of a particular fluid jet cartridge. This can aid in providing a more efficient coverage of composition on a desired surface during use. In particular, the calibration element 78 may include a calibration target 144 having a surface color that is selected to provide contrast between the composition color and the surface color. The nozzles of the fluid jet cartridge can deposit droplets of the skin care composition on the calibration target 144 and the jet dispensing apparatus 30 can use the location of the droplet pattern for a calibration sequence.

Figure 9:
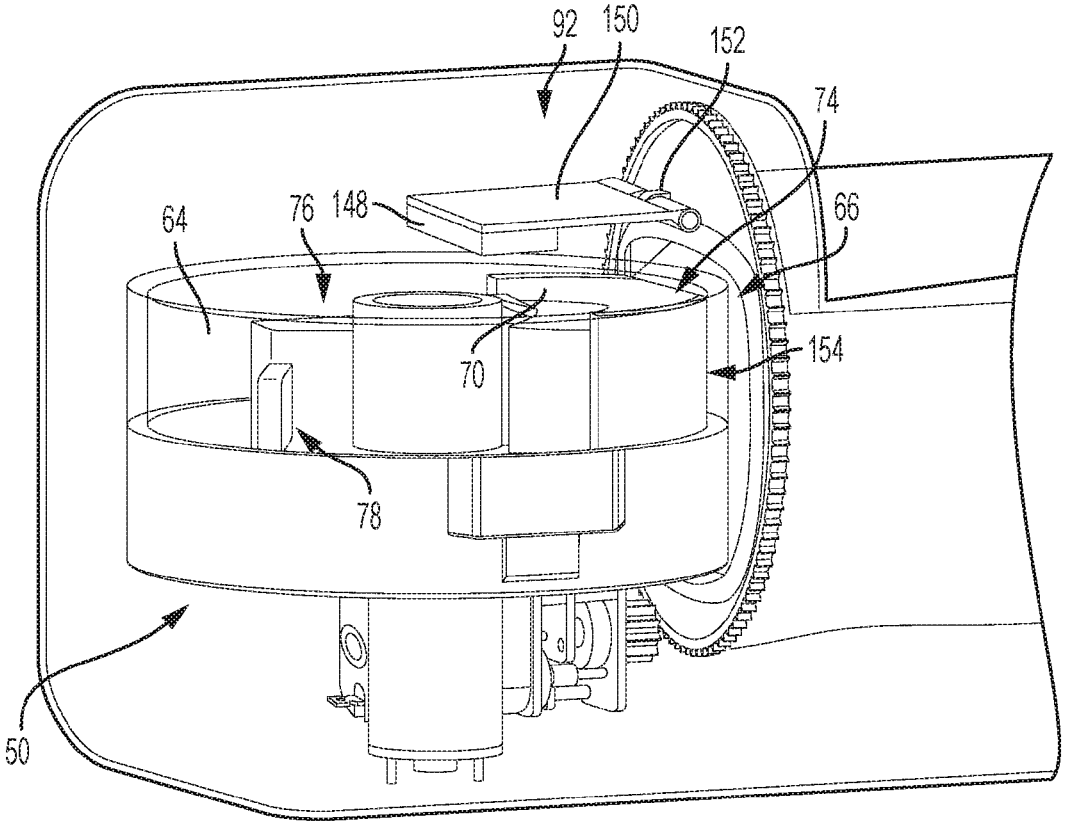
FIG. 9 illustrates operation of the servicing cassette of FIG. 4 in the service station of FIG. 1.

Referring to FIG. 9, operation of the servicing cassette 50 will be described. Initially, the capping element 92 may be in a capped configuration with the nozzles of the fluid jet cartridge (FIG. 3) capped or otherwise covered. The capping element 92 may include a capping component 148 that is carried by a capping arm 150, which is movable cantilevered, for example, to the wall 58 (FIG. 3) of the service station 10. The capping arm 150 may be cantilevered by a biasing component 152 (e.g., a spring) configured to move the capping element between the capped configuration to an uncapped configuration. The capping element 92 may be formed of any suitable material for maintaining humidification of the nozzles during non-use, such as closed and/or open celled foams, plastics, elastomers or combinations of materials.

The controller 94 (FIG. 3) may use the actuator 86 to rotate the rotatable member 66 to an angular position (see, e.g., FIGS. 4 and 5) that provides sufficient clearance between the truncated portion 70 of the outer housing 64 and the end of the capping arm 150, allowing the biasing component 152 to move into the uncapped configuration from the capped configuration. Once the capping element 92 is in the uncapped configuration, the controller 94 may rotate the rotatable actuation member 66 such that the wiping element 74 is positioned in its exposed configuration, as shown by FIG. 9. The rotatable actuation member 66 may be rotated through the exposed configuration of the wiping element 74 to wipe the nozzles 154 and the camera 90 with the nozzle wiping member 130 and the camera lens wiping member 132, respectively.

With the capping element 92 in the uncapped configuration, the controller 94 may rotate the rotatable actuation member 66 such that the composition receiving element 76 is in its exposed configuration. The controller 94 may communicate with the jet dispensing apparatus 30 (e.g., via communications modules 102 and 104) to fire the nozzles 154 for a purging operation once a predetermined angular position of the rotatable actuation member 66 is detected. In some embodiments a position tracking system including a photosensor 160 (FIGS. 4 and 5) may be used by the controller 94 to track angular position (incremental or absolute) of the rotatable actuation member 66.

The controller 94 may rotate the rotatable actuation member 66 such that the calibration element 78 is in its exposed configuration. Again, the controller 94 may communicate with the jet dispensing apparatus 30 (e.g., via communications modules 102 and 104) to fire the nozzles 154 for a calibration operation once a predetermined angular position of the rotatable actuation member 66 is detected. In this calibration operation, composition from the fluid jet cartridge is projected onto the calibration target 144 and the jet dispensing apparatus can initiate a calibration sequence.

Figure 10:
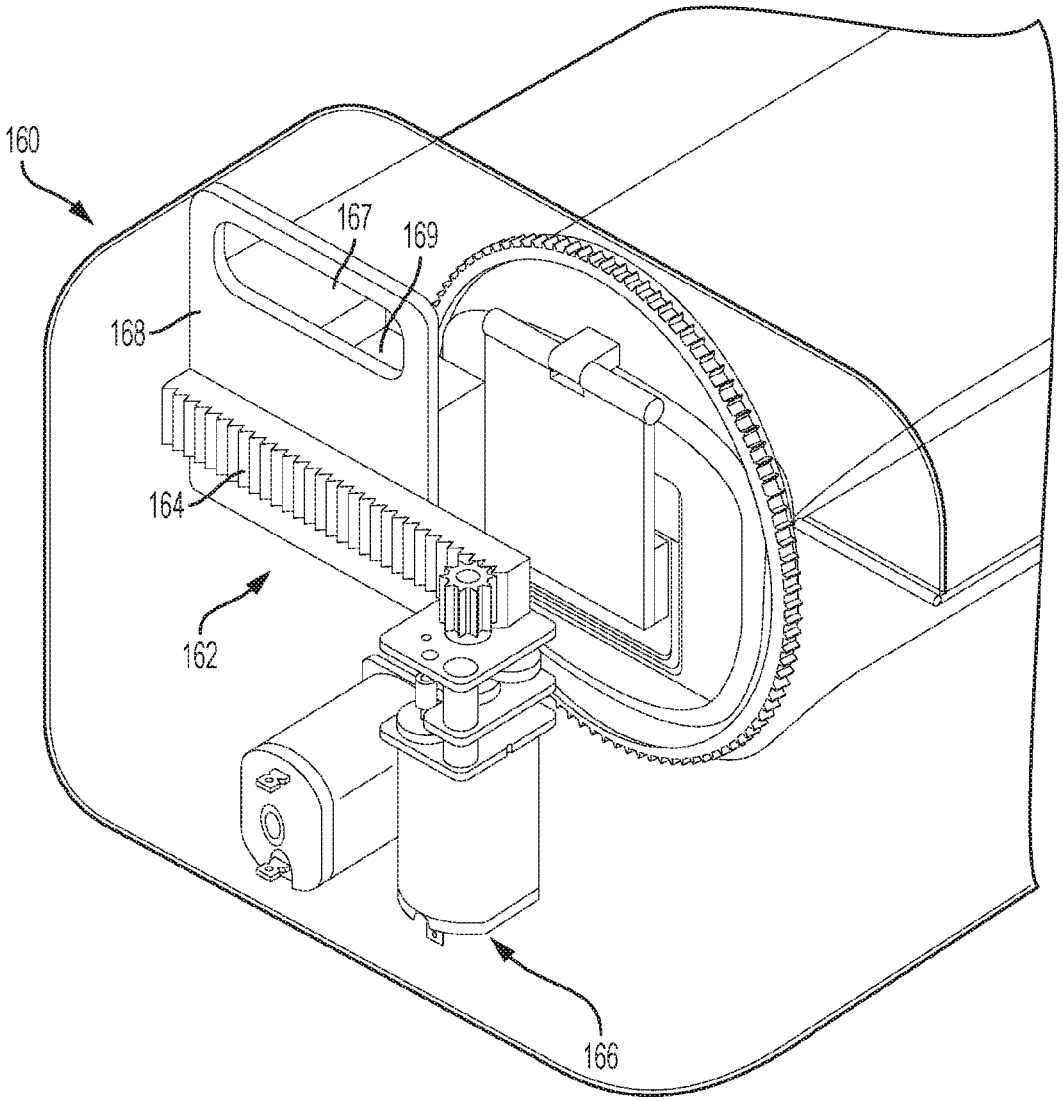
FIG. 10 illustrates another embodiment of a servicing system for servicing the fluid jet apparatus according to one or more embodiments described herein.

While a replaceable, rotatable servicing cassette 50 is described above, other servicing systems are contemplated. Referring to FIG. 10, a servicing system 160 includes a linear actuation system 162 including a linear actuation member 164 that is actuated in a linear fashion by actuator 166. In this embodiment, the linear actuation member 164 is a rack-type gear that is moved linearly with engagement with a pinion-type gear 166 as the gear 166 rotates. The linear actuation member 164 includes a wiping element 167, a composition receiving element 169 in the form of an absorbing pad and can also include a calibration element (not shown), as described above. The linear actuation member 164 may also include a handle element 168 that can be used to remove the servicing system 160 (e.g., for replacement). In other embodiments, serving systems may not be replaceable.

Any suitable gear arrangement can be used to effectuate either rotational and/or linear movement of the servicing system, such as spur gears, rack and pinion gears, internal gears, face gears, helical gears, worm gears, etc. Further, other, non-gear linkages may be used, such as cams. In some embodiments, an actuator may directly actuate the servicing system.

Packaging

Figure 11:
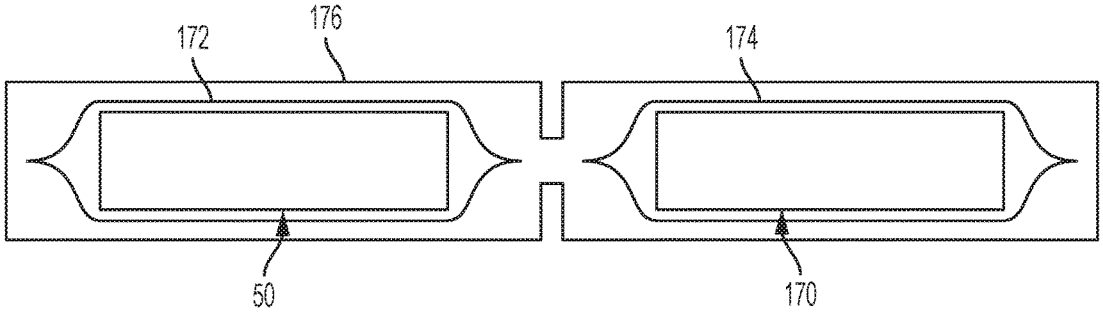
FIG. 11 illustrates a diagrammatic illustration of a package for both a servicing cassette and a fluid jet cartridge according to one or more embodiments described herein.

Referring to FIG. 11, in some embodiments, the servicing cassette 50 may be packaged, shipped and sold with a particular fluid jet cartridge 170. In some embodiments, the servicing cassette 50, for example, may be configured to service the particular jet cartridge 170 having a particular composition. Materials, such as the wiping element of the servicing cassette 50 may be selected based on the particular composition of the fluid jet cartridge 170. In the illustrated example, the servicing cassette 50 and the fluid jet cartridge 170 may be housed in their own primary packaging 172 and 174 and then both housed in the same secondary packaging 176. Any suitable packaging can be used, such as shrink, blister, clamshell, flow wrap, pillow, carton, etc.

Jet Dispensing Apparatus

The term "frexel" is defined as a small pixel-like region of the keratinous surface. A frexel might correspond to a small portion of a freckle or other skin feature, or it may correspond to an area of the keratinous surface that does not have special features. The term frexel is used to suggest that what is being measured is on a 3-D surface rather than a flat surface. A region of keratinous surface is comprised of a plurality of frexels. For instance, if a resolution of 300 dots per inch (11.8 dots per mm or "dpmm") is used, a frexel may have a width and height of about 1/300th of an inch (0.085 mm) so that there are approximately 90,000 frexels per square inch (140 frexels per square mm). The surface of the human body may have millions of frexels.

Figure 12:
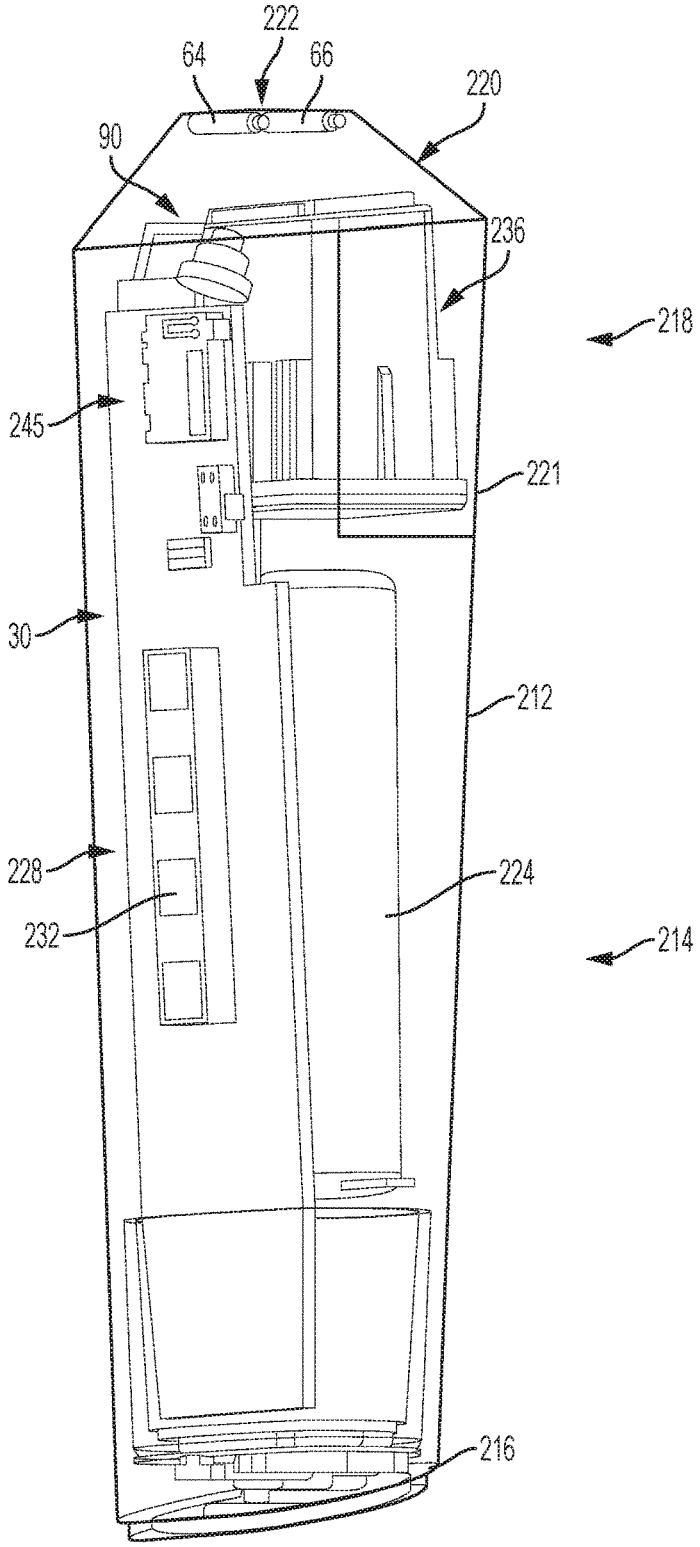
FIG. 12 illustrates a side view of a handheld fluid jet apparatus according to one or more embodiments described herein.

Referring to FIG. 12, the jet dispensing apparatus 30 may be an apparatus for applying compositions to skin generally includes an outer housing 212, which is shown transparent for illustrative purposes that is sized and shaped to be held in-hand and manipulated manually during a treatment operation. While the jet dispensing apparatus 30 may be described primarily for applying compositions to the skin, other applications are possible such as for applying suitable composition to other surfaces treated in consumer applications, such as skin, hair, teeth nails, floors, fabrics, natural and synthetic fibers, wovens, non-wovens, rugs, hard surfaces, pliable surfaces, car bodies, etc. The outer housing 212 includes a graspable portion 214 including a base 216 and an applicator portion 218 including an applicator head 220 having an opening 222 through which a skin care composition can be delivered to the skin. A battery 224 (e.g., a rechargeable battery) may be located in the graspable portion 214 of the outer housing 212. In other embodiments, the jet dispensing apparatus 30 may not include a battery or the jet dispensing apparatus 30 may be plugged, for example, to an electrical supply outlet. In some embodiments, the graspable portion 214 including the base 216 may include lighting for illuminating the base 216 or other locations of the outer housing 212. A user interface 228 may also be provided where a user can provide inputs or control instructions to a processing unit 30 for controlling the jet dispensing apparatus 30. While various buttons or touch areas 232 (e.g., utilizing capacitive touch sensors, momentary switches, etc.) are illustrated for the user to touch and activate, any other suitable input devices may be used, such as touch screen displays, voice commands, etc. In some embodiments, the jet dispensing apparatus 30 may not include a user interface 228. In these embodiments, the jet dispensing apparatus 30 may be primed to be used once removed from the service station 10 without any user input. In some embodiments, the jet dispensing apparatus 30 may be capable of wireless communication and be controlled remotely, e.g., using a cell phone or other handheld computing device, or capable of otherwise sending information wirelessly or wired to an external device, for example, for tracking treatment results.

The applicator portion 218 may include the applicator head 220 including the opening 222 through which the skin care composition can be delivered to the skin and a fluid jet cartridge 236 that is located within the outer housing 212. In some embodiments, the applicator portion 218 may have a removable or otherwise moving portion 221 (e.g., sliding pivoting, etc.) that can be moved to provide access to the fluid jet cartridge 236. As will be described in greater detail below, the cartridge 236 may include a nozzle array that is embedded in a cartridge die. In other embodiments, separate nozzles may be used that can be connected to the cartridge. The applicator head 220 can provide a space between the skin surface at the opening 222 and the nozzle array (and other components) during use. The camera 90 may also be located at the applicator portion 218 and adjacent the fluid jet cartridge 236. The camera 90 can be any of a variety of commercially available devices such as a digital camera. The camera 90 takes a picture of the skin and sends it to the processing unit 230. The processing unit 230 may be generally referred to as a controller, a central processing unit, or CPU, which may comprise a simple circuit board, a more complex computer, or the like. The image may be analyzed by the processing unit 230 to identify skin deviations. A pen driver 245 may be provided to facilitate communication with the processing unit 230 with external devices (e.g., for tracking treatments, such as skin tone affects, time of use, etc.) A variety of lighting may also be provided to illuminate the skin area such that the camera 90 can have constant illumination. The lighting can be, for example, a diode, incandescent light or any other suitable light source.

Figure 13:
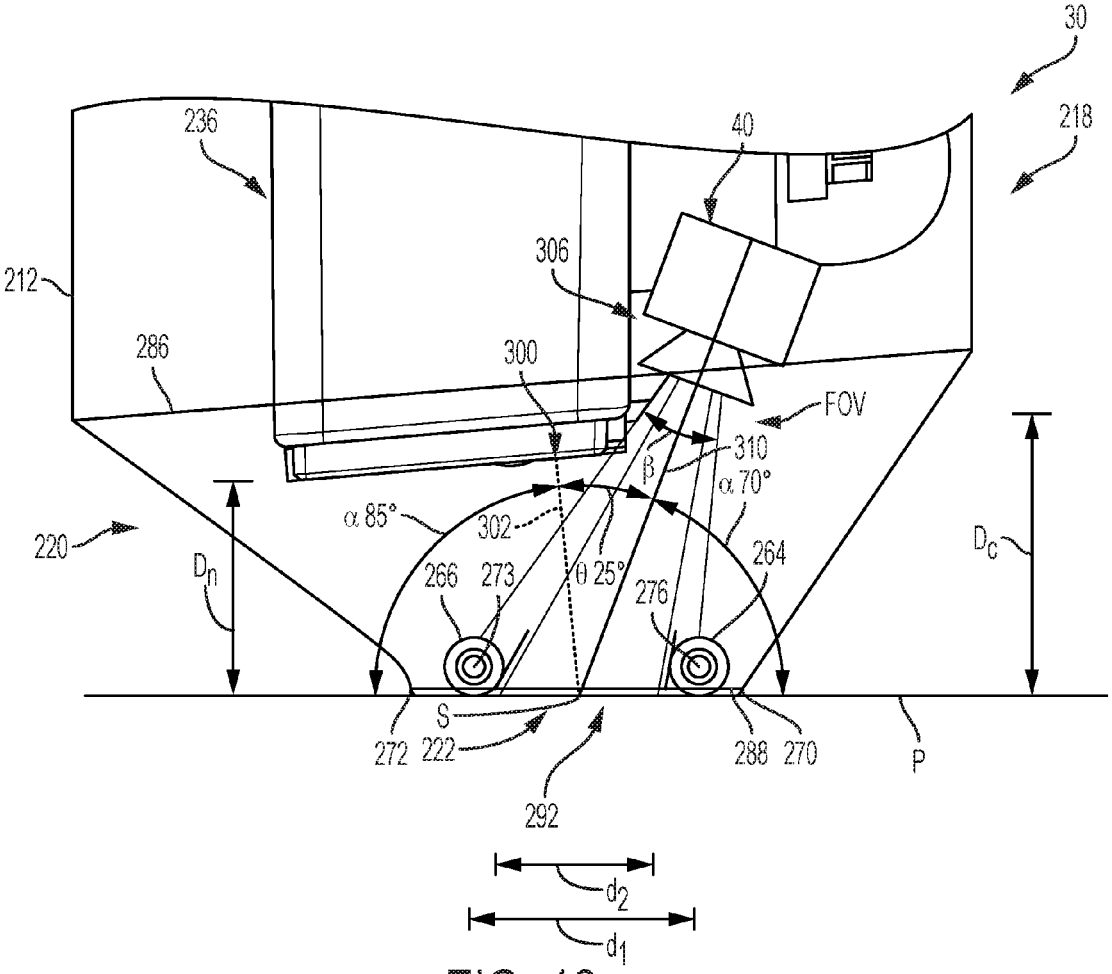
FIG. 13 is a detail view of the fluid jet apparatus of FIG. 12 showing an applicator head according to one or more embodiments described herein.

Referring to FIG. 13, the applicator portion 218 of the jet dispensing apparatus 30 is illustrated with the outer housing 212 being again shown transparent for illustrative purposes. As can be seen, the applicator head 220 includes a housing connector end 286 and a skin engaging end 288 having the opening 222. In some embodiments, the head may be removable (and interchangeable with other heads) with the housing connector end 286 having a releasable connection (e.g., tongue and groove, threaded, etc.) with the outer housing 212. The head 220 is somewhat cone or frustoconical in shape, decreasing in width from the housing connector end 286 to the skin engaging end 288. While the applicator head 220 is shown being somewhat cone-shaped or rounded, it can be of any suitable shape, such as box-shaped, spherical, etc.

Rollers 64 and 66 are located at opposite edges 270 and 272 of the opening 222. The rollers 64 and 66 have outer diameters (e.g., about 2.5 mm) that are sized to extend beyond the edges 270 and 272 for contacting the skin surface, which, for purposes of description, can be represented by a plane P that is tangent to both of the rollers 264 and 266 outside of the head 20, herein referred to as "an imaginary flat rolling surface." The rollers 264 and 266 each rotate around their axes 276 and 278 that are spaced apart a distance $d_1$ (e.g., between about 6 mm and about 15 mm) with a distance $d_2$ (e.g., between about 1 mm and about 10 mm) between the rollers 264 and 266, thereby providing a gap 292 for imaging the skin surface at a location between the rollers 264 and 266. It should be noted that the jet dispensing apparatus 30 may be provided with multiple heads having rollers of various spacing, diameters and surface features. As one example, an applicator head having reduced spacing between rollers may be chosen such that skin bulge detection may be needed.

The applicator head 220 also provides spacing for the fluid jet cartridge 236, its associated nozzle array 300 and the camera 90 from the imaginary flat rolling surface P. Such an arrangement can provide a desired controlled randomness to skin care composition delivery precision, while spacing imaging components away from the skin surface during treatment delivery. In the illustrated embodiment, the nozzle array 300 may be spaced from the imaginary flat rolling surface P a distance $D_n$ of at least about 4 mm, such as at least about 6 mm, such as at least about 8 mm, such as at least about 10 mm. The nozzle array 300 of the fluid jet cartridge 236 may also be offset from perpendicular to the imaginary flat rolling surface P such that a main axis 302 of the nozzle array 300 (the nozzles of the nozzle array may have parallel main axes aligned in a row) may be at an angle $\alpha$ less than 90 degrees (e.g., about 85 degrees or less) to the imaginary flat rolling surface P. As used herein, the "main axis" of a nozzle is a straight line passing through the geometrical center of the nozzle and intersecting the imaginary flat rolling surface P.

The camera 90 may be recessed further away from the imaginary flat rolling surface P than the nozzle array 300. Such an arrangement can reduce the possibility of contamination of the camera 90 by the skin care composition carried by the fluid jet cartridge 236. For example, the camera 90 may include a lens portion 306 that is spaced from the imaginary flat rolling surface P a distance $D_c$ of greater than about 4 mm, such as greater than about 6 mm, such as greater than about 8 mm, such as greater than about 10 mm, such as greater than about 12 mm. The camera 90 has an FOV of an angular dimension $\beta$. As used herein, "field of view" is the region that is visible by the camera. The FOV of the camera 90 extends between the rollers 64 and 66, through the opening 22 to image the skin surface. In some embodiments, the FOV of the camera 90 may include the rollers 64 and 66. Imaging of the rollers 264 and 266 can allow, for example, speed and position detection using the processing unit 230 through image analysis. For example, the rollers 264 and/or 266 may include markers, such as colors, that can be used by the processing unit 230 to determine speed of the jet dispensing apparatus 30 rolling along the skin surface. In some embodiments, the FOV may be adjustable (e.g., using user interface 28) or fixed (i.e., non-adjustable). In some embodiments, the FOV may be about 50 $mm^2$ or more, such as 70 $mm^2$ or more, such as 80 $mm^2$ or more.

The camera 90 may include an optical axis 310 that is offset from perpendicular to the imaginary flat rolling surface P. As used herein, the "optical axis" of the camera 90 is a straight line passing through the geometrical center of the lens of the camera 90 and intersecting the imaginary flat rolling surface P. In some embodiments, the optical axis 310 may be at an angle $\gamma$ of less than 90 degrees, such as less than about 85 degrees, such as less than about 75 degrees, such as less than about 70 degrees from the imaginary flat rolling surface P. In the illustrated embodiment, the main axis 302 of the nozzle array 300 intersects the FOV and meets the optical axis 310 of the camera 90 at the same focal point S (representing a line extending along the parallel axes of the array of nozzles) on the imaginary flat rolling surface P. In some embodiments, an included angle $\theta$ between the optical axis 310 and the main axis 302 may be at least about 10 degrees, such as at least about 15 degrees, such as at least about 25 degrees, but less than about 45 degrees.

Equipment that might be useful in constructing the jet dispensing apparatus 30 are described in the following published patent applications: WO 2008/098234 A2, Handheld Apparatus and Method for the Automated Application of Cosmetics and Other Surfaces, first filed 11 Feb. 2007; WO 2008/100878 A1, System and Method for Applying a Skin care composition to Change a Person's Appearance Based on a Digital Image, first filed 12 Feb. 2007; WO 2008/098235 A2, System and Method for Providing Simulated Images Through Cosmetic Monitoring, first filed 11 Feb. 2007; WO 2008/100880 A1, System and Method for Applying Agent Electrostatically to Human Skin, first filed 12 Feb. 2007; US 2007/0049832 A1, System and Method for Medical Monitoring and Treatment Through Cosmetic Monitoring and Treatment, first filed 12 Aug. 2005; and US 2007/0035815 A1, System and Method for Applying a Skin care composition to Improve the Visual Attractiveness of Human Skin, first filed 12 Aug. 2005, all six applications filed by Edgar et al. The entire disclosure of each of the six Edgar et al. applications is incorporated herein by reference.

The treatment apparatuses described herein may be handheld but can be tethered to a structure that moves the apparatus across the keratinous surface to be modified. If handheld, the consumer would simply move the apparatus across the keratinous surface to be treated. Optionally, multiple apparatuses can be configured in a stationary structure wherein the consumer places the keratinous surface to be modified and multiple readings and applications occur simultaneously or in sequence.

Fluid Jet Cartridge

Figure 14:
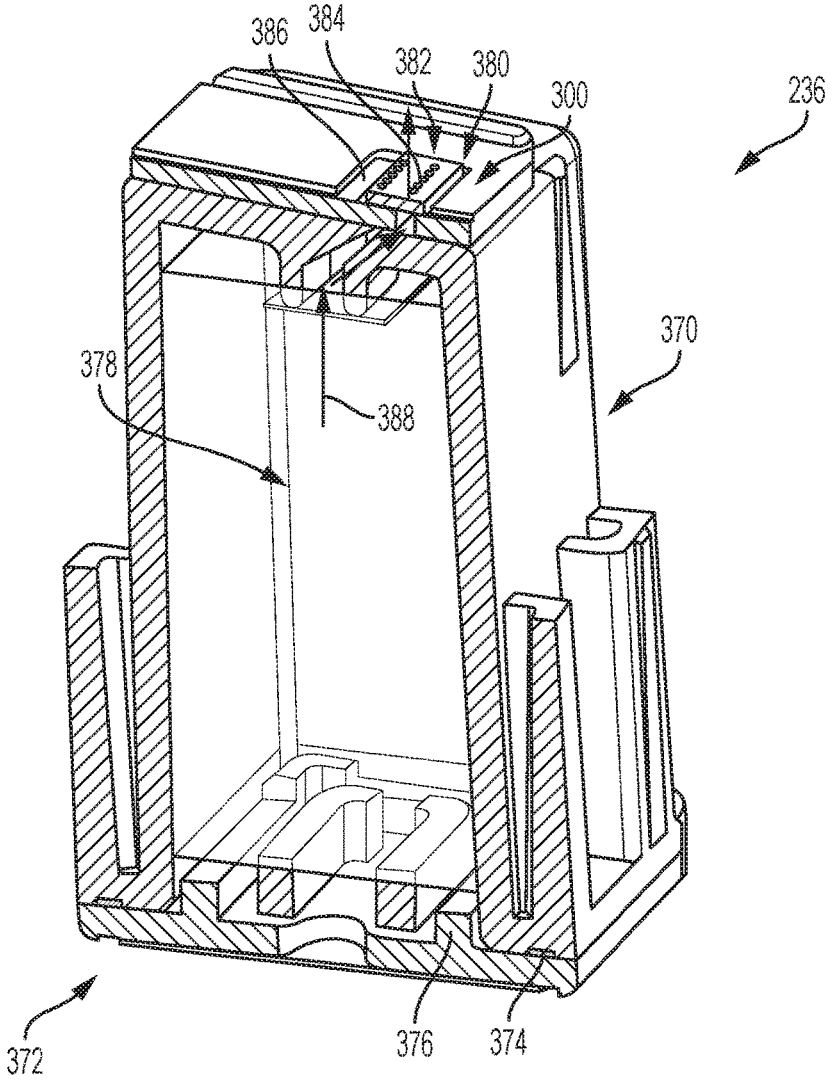
FIG. 14 is a section view of a cartridge for use with the handheld treatment device of FIG. 12 according to one or more embodiments described herein.

Referring now to FIG. 14, the exemplary fluid jet cartridge 236 is illustrated including a cartridge body 370 and a cartridge cap 372 that is sealingly connected to the cartridge body 370 by a seal 374 and a plug 376 providing a friction fit between the cartridge cap 372 and cartridge body 370. The fluid jet cartridge 236 may be considered unitary in that a composition reservoir 378 formed by the cartridge body 370 and print head 380 are formed within a single replaceable unit. In other embodiments, the fluid jet cartridge 236 may not be replaceable. For example, the composition reservoir 378 may be refillable within the jet dispensing apparatus 30. The print head 380 may be a semiconductor device that includes the cartridge die 62 with the nozzle array 300 of a plurality of nozzles 384 fabricated on a semiconductor substrate 386, along with circuitry for addressing the nozzles 384 in response to signals from the processing unit 230. The skin care composition may be delivered from the composition reservoir 378, through a standpipe 388 and out any one or more of the nozzles 384, as described above.

Maintenance Functions

Figure 15:
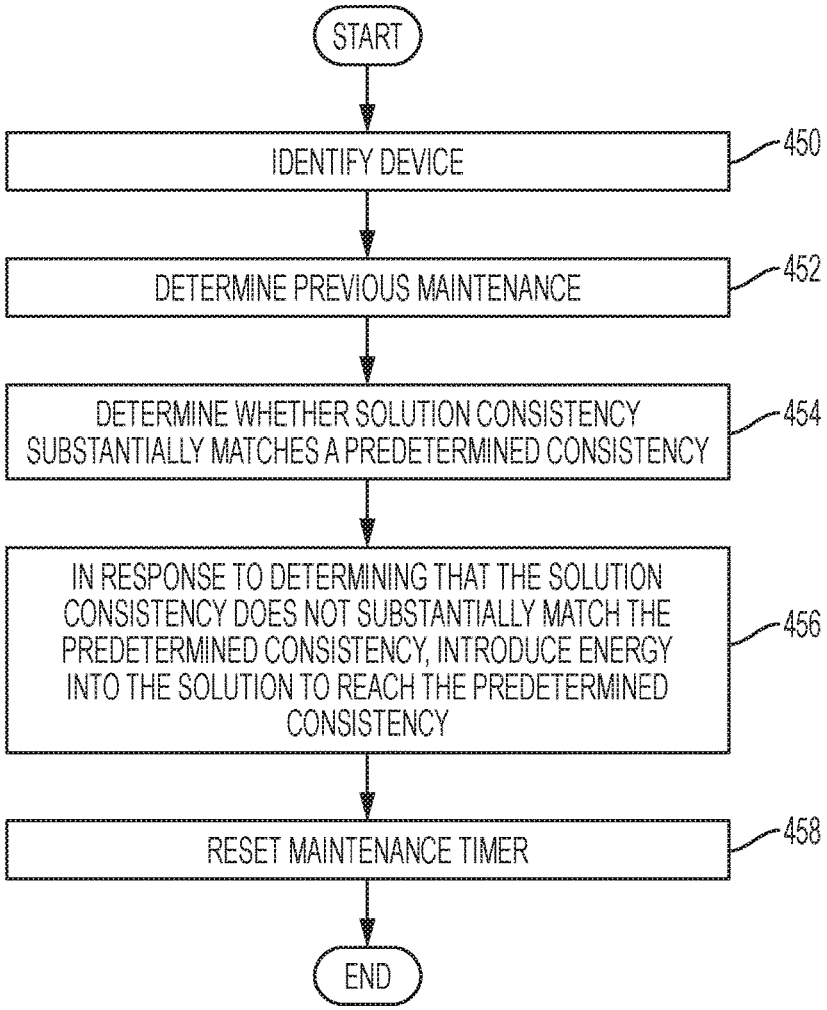
FIG. 15 depicts a flowchart for imparting energy into a reservoir of the handheld jet dispensing apparatus, according to embodiments described herein.

FIG. 15 depicts a flowchart for imparting energy into a reservoir of the handheld jet dispensing apparatus 30, according to embodiments described herein. As illustrated in block 450, the service station 10 may receive the jet dispensing apparatus 30 and identify the device that was received. The jet dispensing apparatus 30 may be configured to communicate with the service station 10 to identify itself, and/or provide other information. The other information may include date of last service, type of last service, malfunctions that have occurred since last service (or at other times), etc. With this information in block 452, the service station 10 may determine the previous maintenance that the jet dispensing apparatus 30 has received. In block 454, the service station 10 may determine whether a fluid homogeneity of the solution substantially matches a predetermined fluid homogeneity. Specifically, the solution in the jet dispensing apparatus 30 may be configured with one or more ingredients for treating skin imperfections, applying solutions to clothing, applying solutions to surfaces, and/or applying solutions to other items. As discussed above, the solution may take any of a plurality of different forms, depending on the particular treatment being performed. Accordingly, if the jet dispensing apparatus 30 and/or the reservoir are stationary or otherwise unused for a period of time, the solution may settle and/or the ingredients that make up the solution may separate. As a consequence, the solution may lack the desired fluid homogeneity for use in the jet dispensing apparatus 30. Thus, the service station 10 (and/or the jet dispensing apparatus 30) may include one or more sensors for determining the fluid homogeneity of the solution.

As an example, the jet dispensing apparatus 30 may include a timer to determine movement, use, and/or timing of movement or use of the jet dispensing apparatus 30 to determine whether the time exceeds a time that would change the consistency of the solution beyond a desired level. Similarly, some embodiments may be configured with an opacity sensor or light sensor to determine whether the solution has the desired opacity. If the opacity of the solution is not at a desired level, the service station 10 may determine that the consistency does not meet a predetermined consistency. Other sensors and determinations may also be made.

A variety of compositions may be used, for example, inks, dyes, pigments, adhesives, curable compositions, optically activated compounds, metal oxides (for example, $TiO_2$), bleaching agents, texture reducing polymers, skin care compositions, acne treatment compositions, hair colorants, hair removal compositions (often referred to as depilatories), hair growth stimulants and mixtures thereof.

The skin care compositions can be delivered alone or in the presence of a dermatologically-acceptable carrier. The phrase "dermatologically-acceptable carrier", as used herein, means that the carrier is suitable for topical application to the keratinous tissue, has good aesthetic properties, is compatible with any additional components of the skin care composition, and will not cause any untoward safety or toxicity concerns. The carrier can be in a wide variety of forms. Non-limiting examples include simple solutions (water or oil based), emulsions, and solid forms (gels, sticks, flowable solids, amorphous materials). In certain embodiments, the dermatologically acceptable carrier is in the form of an emulsion. Emulsion may be generally classified as having a continuous aqueous phase (e.g., oil-in-water and water-in-oil-in-water) or a continuous oil phase (e.g., water-in-oil and oil-in-water-in-oil). The oil phase may comprise silicone oils, non-silicone oils such as hydrocarbon oils, esters, ethers, and the like, and mixtures thereof. For example, emulsion carriers can include, but are not limited to, continuous water phase emulsions such as silicone-in-water, oil-in-water, and water-in-oil-in-water emulsion; and continuous oil phase emulsions such as water-in-oil and water-in-silicone emulsions, and oil-in-water-in-silicone emulsions. The skin care composition can be delivered in a variety of product forms including, but not limited to, a cream, a lotion, a gel, a foam, a paste, or a serum. Additionally, the skin care composition can include for purposes of proper formulation and stabilization anti-fungal and anti-bacterial components.

The skin care compositions may include humectants as a carrier or chassis for the other components in the skin care composition. An exemplary class of humectants is polyhydric alcohols. Suitable polyhydric alcohols include polyalkylene glycols and alkylene polyols and their derivatives, including propylene glycol, dipropylene glycol, polypropylene glycol, polyethylene glycol and derivatives thereof; sorbitol; hydroxypropyl sorbitol; erythritol; threitol; pentaerythritol; xylitol; glucitol; mannitol; butylene glycol (e.g., 1,3-butylene glycol); pentylene glycol; hexane triol (e.g., 1,2,6-hexanetriol); glycerin; ethoxylated glycerine; and propoxylated glycerine.

Other suitable humectants include sodium 2-pyrrolidone-5-carboxylate, guanidine; glycolic acid and glycolate salts (e.g., ammonium and quaternary alkyl ammonium); lactic acid and lactate salts (e.g., ammonium and quaternary alkyl ammonium); aloe vera in any of its variety of forms (e.g., aloe vera gel); hyaluronic acid and derivatives thereof (e.g., salt derivatives such as sodium hyaluronate); lactamide monoethanolamine; acetamide monoethanolamine; urea; sodium pyroglutamate, water-soluble glyceryl poly(meth) acrylate lubricants (such as Hispagel®) and mixtures thereof.

Materials that are used to treat acne can also be applied with the jet dispensing apparatus 30. Suitable acne treatment materials include clindamycin, retinoic acid, salicylic acid, benzoyl peroxide, sulphacetamide, or mixtures thereof.

Inks, dyes, metal oxides and pigments (collectively referred to as "colorants" below) are used to modify the color or reflectance of the keratinous surface. These compositions are commonly used to modify color and reflectance in cosmetic, "make-up" compositions. Foundation, lipstick, eyeliner are just a few examples of these compositions, but they are all applied evenly across large portions of the keratinous surface, that is they are macro-applications. In sharp contrast, the present skin care compositions are selectively applied on a very small scale to select areas, that is, a micro application. Suitable colorants may include inorganic or organic pigments and powders. Organic pigments can include natural colorants and synthetic monomeric and polymeric colorants. Organic pigments include various aromatic types such as azo, indigoid, triphenylmethane, anthraquinone, and xanthine dyes which are designated as D&C and FD&C blues, browns, greens, oranges, reds, yellows, etc. Organic pigments may consist of insoluble metallic salts of certified color additives, referred to as the Lakes. Inorganic pigments include iron oxides, ferric ammonium ferrocyanide, manganese violet, ultramarines, chromium, chromium hydroxide colors, and mixtures thereof. The pigments may be coated with one or more ingredients that cause the pigments to be hydrophobic. Suitable coating materials that will render the pigments more lipophilic in nature include silicones, lecithin, amino acids, phospholipids, inorganic and organic oils, polyethylene, and other polymeric materials. Suitable silicone treated pigments as disclosed in U.S. Pat. No. 5,143,722. Inorganic white or uncolored pigments include $TiO_2$, ZnO, or $ZrO_2$, which are commercially available from a number of sources. Other suitable colorants are identified in U.S. Pat. No. 7,166,279. Colorants are generally included at a weight percent such that the skin care composition yields a perceptible color. In one embodiment, the skin care composition exhibits a color that perceptibly different from the color of the applicator. By perceptibly different, refers to a difference in color that is perceptible to a person having normal sensory abilities under standard lighting conditions (e.g., natural illumination as experienced outdoors during daylight hours, the illumination of a standard 100 watt incandescent white light bulb at a distance of 2 meters, or as defined by CIE D65 standard illuminate lighting at 800 lux to a 1964 CIE standard observer).

Adhesives that are compatible with keratinous surfaces are known any such adhesive can be applied with the jet dispensing apparatus 30. Commercially available adhesives compatible with keratinous surfaces are available from the 3M Corporation of Minneapolis Minn. See, for example: U.S. Pat. No. 6,461,467, issued to Blatchford, et al., filed on Apr. 23, 2001; U.S. Pat. No. 5,614,310, issued to Delgado, et al., filed on Nov. 4, 1994; and U.S. Pat. No. 5,160,315, issued to Heinecke et al., filed on Apr. 5, 1991. The entire disclosures of these patent applications are incorporated by reference. After the adhesive is selectively applied to the keratinous surface, a second skin care composition can be dusted on the keratinous surface where it will stick the adhesive. The second modification that is not adhered to the keratinous surface can then be removed leaving behind a selective, micro application of the second skin care composition. Likewise compositions that cure upon exposure to certain wavelengths of energy, infrared light for example, can be applied. By this method, the curable composition is selectively applied to the keratinous surface and then it is cured by exposing the keratinous surface to the curing energy source. The entire keratinous surface can be exposed, or the exposure can be done at the same time as the application.

Wrinkle or texture reducing polymers and skin tightening may be used. See, for example: U.S. Pat. No. 6,139,829, issued to Estrin on Oct. 31, 2000; and US Patent Applications US20060210513A1, filed by Luizzi, et al. on Mar. 21, 2005; US20070224158A1, filed by Cassin et al. on Mar. 18, 2005; and US20070148120A1, filed by Omura et al. on Jan. 14, 2005. The entire disclosures of this patent and these published patent applications are incorporated by reference. More specifically, a cosmetic process for softening the wrinkles of wrinkled skin may comprise applying, to the wrinkled skin, a cosmetic composition, in particular an anti-wrinkle composition, comprising, in a physiologically acceptable medium suitable for topical application to the skin of the face: from 0.1 to 20% by weight of at least one tensioning agent, with respect to the total weight of the composition.

Optically-activated particles can be used as or added to the skin care compositions. Sometimes referred to a "interference pigments", these particles include a plurality of substrate particles selected from the group consisting of nylons, acrylics, polyesters, other plastic polymers, natural materials, regenerated cellulose, metals and minerals; an optical brightener chemically bonded to each of the plurality of substrate particles to form integral units in the form of optically-activated particles for diffusing light. These particles help to reduce the visual perception of skin imperfections, including cellulite, shadows, skin discolorations, and wrinkles. Each of the optically-activated particles are encapsulated with a UV transparent coating to increase the diffusion light to further reduce the visual perception of the skin imperfections. The encapsulated optically-activated particles are able to absorb ultraviolet radiation and emit visible light; and the encapsulated optically-activated particles are able to both scatter and absorb light in a diffuse manner in order to reduce the visual perception of skin imperfections, including cellulite, wrinkles, shadows, and skin discolorations, when the optically-activated particles are applied to the skin surface.

Hair colorants and hair removal compositions are also suitable for use with the handheld treatment apparatus. These compositions, and their component parts, may be described by the examples given below. Each of the individual chemical compositions described below for hair colorants can be used in combination with any of the others ingredients, and likewise, those skilled in the art will appreciate that the individual compositions given for depilatories can be used with other ingredients listed in other examples.

Skin care compositions can be applied with the jet dispensing apparatus 30. The skin care composition may be used as, for example, a moisturizer, a conditioner, an anti-aging treatment, a skin lightening treatment, a sunscreen, a sunless tanner, and combinations thereof. The skin care composition may comprise a safe and effective amount of one or more skin care active ("active") useful for regulating and/or improving skin condition. "Safe and effective amount" means an amount of a compound or composition sufficient to induce a positive benefit but low enough to avoid serious side effects (i.e., provides a reasonable benefit to risk ratio within the judgment of a skilled artisan). A safe and effective amount of a skin care active can be from about $1\times10^{-6}$ to about 25% by weight of the total composition, in another embodiment from about 0.0001 to about 25% by weight of the total composition, in another embodiment from about 0.01 to about 10% by weight of the total composition, in another embodiment from about 0.1 to about 5% by weight of the total composition, in another embodiment from about 0.2 to about 2% by weight of the total composition. Suitable actives include, but are not limited to, vitamins (e.g., B3 compounds such as niacinamide, niacin-nicotinic acid, tocopheryl nicotinate; B5 compounds, such as panthenol; vitamin A compounds and natural and/or synthetic analogs of Vitamin A, including retinoids, retinol, retinyl acetate, retinyl palmitate, retinoic acid, retinaldehyde, retinyl propionate, carotenoids (pro-vitamin A); vitamin E compounds, or tocopherol, including tocopherol sorbate, tocopherol acetate; vitamin C compounds, including ascorbate, ascorbyl esters of fatty acids, and ascorbic acid derivatives such as magnesium ascorbyl phosphate and sodium ascorbyl phosphate, ascorbyl glucoside, and ascorbyl sorbate), peptides (e.g., peptides containing ten or fewer amino acids, their derivatives, isomers, and complexes with other species such as metal ions), sugar amines (e.g., N-acetyl-glucosamine), sunscreens, oil control agents, tanning actives, anti-acne actives, desquamation actives, anti-cellulite actives, chelating agents, skin lightening agents, flavonoids, protease inhibitors (e.g., hexamidine and derivatives), non-vitamin antioxidants and radical scavengers, peptides, salicylic acid, hair growth regulators, anti-wrinkle actives, anti-atrophy actives, minerals, phytosterols and/or plant hormones, tyrosinase inhibitors, N-acyl amino acid compounds, moisturizers, plant extracts, and derivatives of any of the aforementioned actives. The term "derivative" as used herein refers to structures which are not shown but which one skilled in the art would understand are variations of the basic compound. For example, removing a hydrogen atom from benzene and replacing it with a methyl group. Suitable actives are further described in U.S. application publication No. US2006/0275237A1 and US2004/0175347A1.

As indicated above, maintenance of the jet dispensing apparatus 30 can be important, for example, to prevent clogging of the nozzle array 100 and, in some embodiments, to charge the battery 24 for continued use. For example, it may be undesirable to store the handheld treatment device in an upstanding orientation on the base 16 (FIG. 1). To this end, the base 16 may be angled or some other surface contour to prevent a user from standing the jet dispensing apparatus 30 upright on its base 16.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiments disclosed, or in any combination with any other reference or references, teaches, suggests or discloses any such embodiments. Further, to the extent that any meaning or definition of a term in this document conflicts with any meaning or definition of the same term in a document incorporated by reference, the meaning or definition assigned to that term in this document shall govern.

While particular embodiments have been illustrated and described, it would be obvious to those skilled in the art that various other changes and modifications can be made without departing from the spirit and scope of the claims. It is therefore intended to cover in the appended claims all such changes and modifications that are within the scope of this specification.

What is claimed is:

1. A service station for servicing a handheld jet dispensing apparatus comprising a fluid jet cartridge carrying a composition and a camera for capturing an image of a surface, the service station comprising:

a body having a docking portion that is sized to receive the jet dispensing apparatus;

a servicing portion located adjacent the docking portion, the servicing portion configured to receive a replaceable servicing cassette and to position the servicing cassette for interaction with nozzles of the fluid jet cartridge of the jet dispensing apparatus for a cartridge servicing operation; and an actuator configured to move the servicing cassette during the cartridge servicing operation relative to the fluid jet cartridge of the handheld jet dispensing apparatus with the handheld jet dispensing apparatus in the docking portion.

2. The service station of claim 1, wherein the servicing portion includes a chamber located in the body that is sized to removably receive the servicing cassette.

3. The service station of claim 2, wherein an access opening is arranged between the chamber and the docking portion to expose the nozzles of the fluid jet cartridge to the servicing cassette with the handheld jet dispensing apparatus received by the docking portion.

4. The service station of claim 1 further comprising a door having an open configuration for access to the docking portion and a closed configuration to prevent access to the docking portion.

5. The service station of claim 1 further comprising a replaceable servicing cassette located in the servicing portion.

6. The service station of claim 1 further comprising a controller that controls operation of the actuator.

7. The service station of claim 1 further comprising a handheld jet dispensing apparatus located in the docking portion, the handheld jet dispensing apparatus comprising a fluid jet cartridge comprising an array of nozzles for delivering a composition.

8. The service station of claim 7, wherein the composition is a skin care composition.

9. A method for servicing a handheld jet dispensing apparatus comprising a fluid jet cartridge carrying a composition and a camera for capturing an image of a surface using a service station, the method comprising:

positioning the jet dispensing apparatus in a docking portion defined in a body of the service station that is sized to receive the handheld jet dispensing apparatus; and actuating a replaceable servicing cassette relative to the jet dispensing apparatus, the servicing cassette located at a service portion adjacent the docking portion, the servicing cassette located for interaction with nozzles of the fluid jet cartridge for a cartridge servicing operation.

10. The method of claim 9 further comprising replacing the servicing cassette with another servicing cassette.

11. The method of claim 9 further comprising capping at least one of the nozzles of the fluid jet cartridge using a capping assembly comprising a capping element that covers the at least one of the nozzles with the rotatable actuation member of the servicing cassette in a predetermined position.

12. The method of claim 9, wherein the composition is a skin care composition.

* * * * *